United States Patent [19]

van Maanen

[11] Patent Number: 4,467,589

[45] Date of Patent: Aug. 28, 1984

[54] METHOD AND APPARATUS FOR SPLICING PACKING MATERIAL WEBS

[75] Inventor: Johannes D. van Maanen, Berkel En Rodenrijs, Netherlands

[73] Assignee: Tevopharm-Schiedam B.V., Schiedam, Netherlands

[21] Appl. No.: 328,513

[22] Filed: Dec. 8, 1981

[30] Foreign Application Priority Data

Mar. 31, 1981 [NL] Netherlands ..... 8101588

[51] Int. Cl.³ ..... B65B 41/16; B65B 41/18

[52] U.S. Cl. ..... 53/450; 53/475; 53/51; 53/550; 53/244; 53/389; 156/164

[58] Field of Search ..... 53/450, 475, 51, 550, 53/389, 244, 251; 156/164, 166, 361, 428, 379, 69

[56] References Cited

U.S. PATENT DOCUMENTS

| | | | |
|---|---|---|---|
| 3,853,668 | 12/1974 | Onishi et al. | 156/164 X |
| 3,861,983 | 1/1975 | Harrell | 156/69 X |
| 4,067,760 | 1/1978 | Nelson | 156/379 X |
| 4,128,985 | 12/1978 | Simmons | 53/51 |
| 4,381,637 | 5/1983 | Ballestrazzi et al. | 53/51 |

*Primary Examiner*—Horace M. Culver

[57] ABSTRACT

A method for splicing the trailing end portion of an advancing web of packing material to the leading end portion of an initially stationary second web of the same packing material such that after splicing marks provided on each of the webs in an equally spaced relation continue as an uninterrupted regular row, in particular in a packing machine. The articles to be packed are advanced spaced apart as a continuous flow into a web of packing material folded to a tube and are carried and advanced along sealing stations by the advancing tube for producing a longitudinal sealing seam and transverse sealing seams in the packing material between the articles. The transverse seams are cut thereafter and the discrete packed articles are discharged on a coveyor, in which the first web runs over a roller and the leading end portion provided with an adhesive of the second web is placed over a second roller opposite to the first roller. Upon passing a predetermined point by the trailing end of the first web an initiating signal is excited and supplied to a controlling device for conditioning this and upon passing a predetermined point by a mark on the first web a signal is generated by which the conditioned controlling device delivers a command to a displacing device for its operation, by which said rollers are pressed against each other and the splicing is carried out. The period of time (t) is determined between the actuation of the displacing device and the mutual engagement of said rollers, and between the signal generated by a mark and the command from the controlling device a lapse of time (Tn−t) is set, in which Tn is obtained by dividing at least one spacing between two subsequent marks by the velocity of the first web.

11 Claims, 7 Drawing Figures

METHOD AND APPARATUS FOR SPLICING PACKING MATERIAL WEBS

Figure 1:
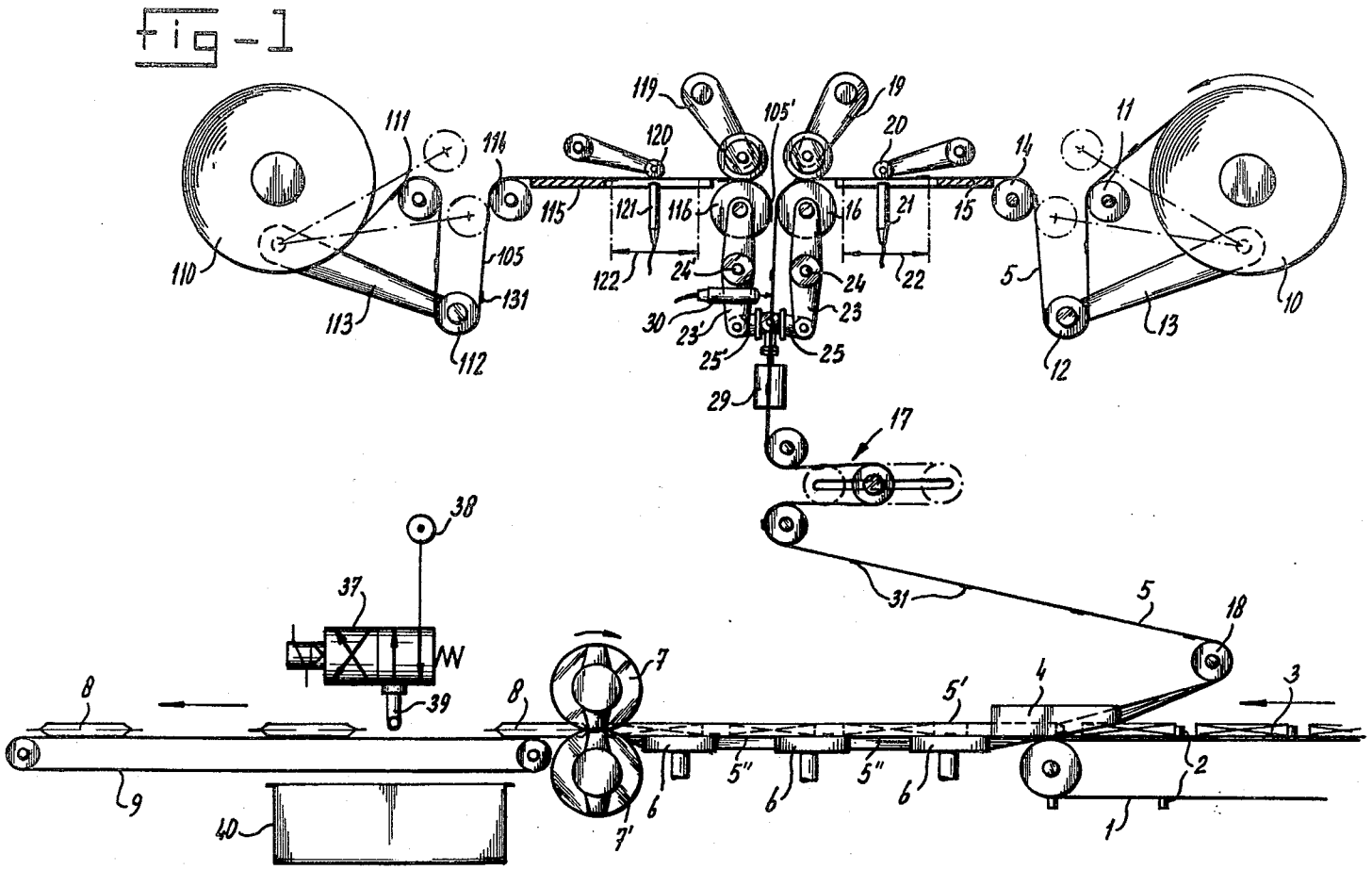

The invention relates to a method for splicing the trailing end portion of an advancing web of packing material to the leading end portion of an initially stationary second web of the same packing material, such that after splicing marks provided on each of said webs in an equally spaced relation continue as an uninterrupted regular row, in particular in a packing machine. The articles to be packed are advanced spaced apart as a continuous flow into the packing material web folded to a tube and are carried and advanced along sealing stations by the advancing tube for providing a longitudinal sealing seam and transverse sealing seams in the packing material between the articles. The transverse sealing seams are cut thereafter, after which the discrete packed articles are discharged on a discharge conveyor. The first web runs over a roller and the leading end portion provided with an adhesive of the second web is placed over a second roller opposite to the first roller and upon passing a predetermined point by the trailing end of the first web an initiating signal is delivered and supplied to a controlling device for conditioning this and upon passing a predetermined point by a mark on the first web a signal is generated by which the conditioned controlling device delivers a command to a displacing device for its operation, by which said rollers are pressed against each other and the splicing is carried out. Such a method is known from U.S. Pat. No. 3,328,488.

In particular in a packing machine of the above mentioned type it is of great importance that the machine can operate continuously and needs not to be stopped when the supply of packing material generally in form of a roll is depleted or when rupture occurs in the material web. Therefore, it is already proposed to have in readiness a second roll of packing material in the machine and to make such provisions that upon detection by a sensing device of a loose trailing end of the material web said loose end while advancing is adhered automatically to the leading end of the second stand-by roll, wherafter the second roll is unwound and the roll entirely consumed or not is substituted by a new full roll of packing material representing then the stand-by roll, of which the leading end is spliced again to the trailing end of the second roll etc.

The packing material web is practically always printed someway with successive patterns, for example inscriptions, the size of each pattern being based on the length of an article to be packed so that the transverse sealing seams should be provided as accurate as possible between two successive prints. For controlling this the webs of packing material are provided with marks, preferably the spacing between two marks being equal to the length of material per article to be packed, so that the transverse sealing seams are cut at the location of a mark.

It is self-evident that it is of extremely great importance that the splicing of the one web of packing material to the other is carried out such that the marks continue as an uninterrupted row, as only then it will be assured that the articles are packed in the correct way with respect to the printed inscriptions; it is unacceptable that packed articles are obtained in which for example first the final part and thereafter the first part of an inscription is visible. Moreover, by an incorrect adherence with respect of the marks it may happen that the adhesive, for example a piece of adhesive tape comes to lie at the position of a transverse sealing seam by which said sealing seam cannot be cut.

In the known method, by the initiating signal a contact is closed, while by means, for example of a disk driven synchronously with the driving means of the packing machine, a second contact is closed at the correct moment with respect to the by which an electromagnet is energized pulling the one roller against the other and the splicing is carried out for example such that a mark on the trailing end of the one web coincides with a mark on the leading end of the other web.

Herein, the time is not taken into account which elapses between the energizing of the electromagnet and the moment at which the splicing is caused by the roller, which time can amount to at least 50 ms, so that for example at a velocity of the material web of one meter per second a deviation of at least 50 mm occurs between the marks which would coincide in splicing the webs to each other in stationary condition. Moreover, in a packing machine the operation velocity and thereby the velocity of the material web can vary extremely so that after having adjusted a correct splicing operation for a predetermined velocity, the splicing is not correct anymore at a higher or lower velocity.

The invention has the object to provide a method as mentioned above, in which at each velocity of the material web it is spliced to the other material web correctly with respect to the marks.

This object is achieved in that in the method according to the invention the period of time (t) is determined between the actuation of the displacing device and the mutual engagement of the above-mentioned rollers, and between the signal generated by a mark and the command from the controlling device a lapse of time of (Tn−t) is set in which Tn is obtained by dividing at least one spacing between two successive marks by the velocity of the first web.

In this way it is achieved that at each velocity of the material web the command to the displacing device is given at a moment t units of time before the moment at which a signal is generated by a mark, so that at the time of said signal the splicing is carried out actually.

Advantageously a signal from a mark actuates a time relay causing a pulse counter to operate after the time t and then is reset to zero again, which pulse counter counts the pulses delivered by a pulse generator driven synchronously with the driving means, until a second signal is generated by a mark by which the pulse counter counts down to zero and upon arriving at zero causes the conditioned controlling device to deliver the command to the displacing device.

In this way, first, dependent on the velocity of the material web a period of time (Tn−t) is determined by the pulse counter and thereafter after the generation of the second signal by a mark said period of time is set by the pulse counter such that at the moment t units of time before the moment at which a third signal is generated by a mark the command is delivered to the displacing device. This means that only after three successive marks have passed said point resulting in the generation of three signals, the splicing of the one material web to the other takes place, what may be objectionable.

Therefore, it is preferable that the second signal generated by a mark also actuates the time relay which after the time t causes the second pulse counter to operate for counting the pulses generated by the pulse generator until a third signal generated by a mark, after which the second pulse counter counts down to zero again and upon arriving at zero causes the conditioned controlling device to deliver the command to the displacing device by which it is obtained that at a moment between every two successive marks a splicing may be carried out.

After the one material web is spliced to the other an area is formed at the splicing location where both of the material webs overlap each other with the adhesive therebetween, which area results in an ugly different packing so that the articles packed in those portions of the packing material comprising portions of said area should be removed.

In the method according to the invention this can be achieved in a simple way in that by the command to the displacing device at the same time a mark counter is actuated which opens after a set count a valve of a blowing nozzle, by which at least one packed article is blown away from the discharge conveyor, said count being set such that said packed article is packed in the portion of the packing material comprising the joint of the first to the second material web.

As in a packing machine of the above mentioned type the velocity of the material web with respect to the rotational velocity of the sealing jaws forming the transverse sealing seams is monitored continuously and changed if necessary in order to compensate for strain differences in the material web, variations in the sizes of the articles to be packed and so on, in which the variation of the velocity of the material web is carried out during a predetermined period of time, it may happen that such a variation of velocity occurs during too long a period of time so that a certain number of articles is not packed correctly with respect to the pattern printed on the packing material, which packings should be removed.

Said removal of articles being not packed correctly can be carried out in a simple way in the method according to the invention, in that each signal generated by a mark is also fed to a controlling device, where said signal is compared with a signal generated by a signal generator driven synchronously with the driving means of the packing machine, which comparing device, when the mark signal does not fall within the signal generated by the signal generator, opens the valve of the blowing nozzle until the first signal falls again within the latter signal.

The invention relates also to an apparatus for carrying out the method, which device is characterized in that a pulse generator driven synchronously with the driving means is provided and a time relay which can be actuated by a signal from a mark, while a pulse counter is provided which after the lapse of a predetermined time is actuated by the time relay counts the pulses generated by the pulse generator, counts down again to zero caused by the second signal from a mark and at arriving at zero causes the controlling device to deliver the command to the displacing device for pressing the rollers against each other.

Preferably a second pulse counter is provided which operates similarly as the first pulse counter, both of the pulse counters being connected to the time relay through a flip flop switch.

Advantageously a mark counter is provided which is actuated by the command from the controlling device and at the discharge conveyor of the packing machine a blowing nozzle having a self-closing valve is placed which valve can be opened by the counter.

Further a signal generator can be provided which is driven synchronously with the sealing jaws and a controlling device in which a signal generated by a mark is compared with a signal from the signal generator, which comparing and controlling device when the mark signal does not fall within the signal generated by the signal generator opens the valve of the blowing nozzle until the first signal falls within the latter signal again.

Preferably the signal generator comprises a rotatable disk in which circumferentially at least one substantially rectangular portion is cut out and an opposing inductive sensor so that when the rectangular portion passes the sensor a signal is delivered having a period of time proportional to the length of the rectangular portion.

In a device in which the means for pressing the rollers against each other, comprise a double active electromagnet and at least one of the rollers is fixed to an arm mounted pivotably and with which the electromagnet is in engagement, according to the invention, each roller is provided at the one end of an arm mounted for a pivotal movement near its center, whereas the other ends of the arms are connected to the electromagnet through a toggle lever. In this way both of the rollers are moved to each other so that covering the distance between the rollers requires less time, while the rollers are urged vigorously against each other by which a perfect splicing can be obtained.

It is noted that from U.S. Pat. No. 3,075,718 an apparatus is known for splicing the trailing end portion of an advancing web of packing material to the leading end portion provided with an adhesive of a second initially stationary web of packing material, in which the rollers over which said webs are passed are pressed against each other by means of excentric rollers, which excentric rollers are actuated at a predetermined moment after the excentric rollers are coupled to the driving means by means of the signal generated by the end of a material web passing a sensor. In this connection it is noticed in said patent that the rollers may be pressed against each other by means of an electromagnet, but that such a magnet consumes a certain time for its operation so that by differences in the operational velocity of the packing machine the splicing may be carried out incorrectly with respect to the marks.

Figure 2:
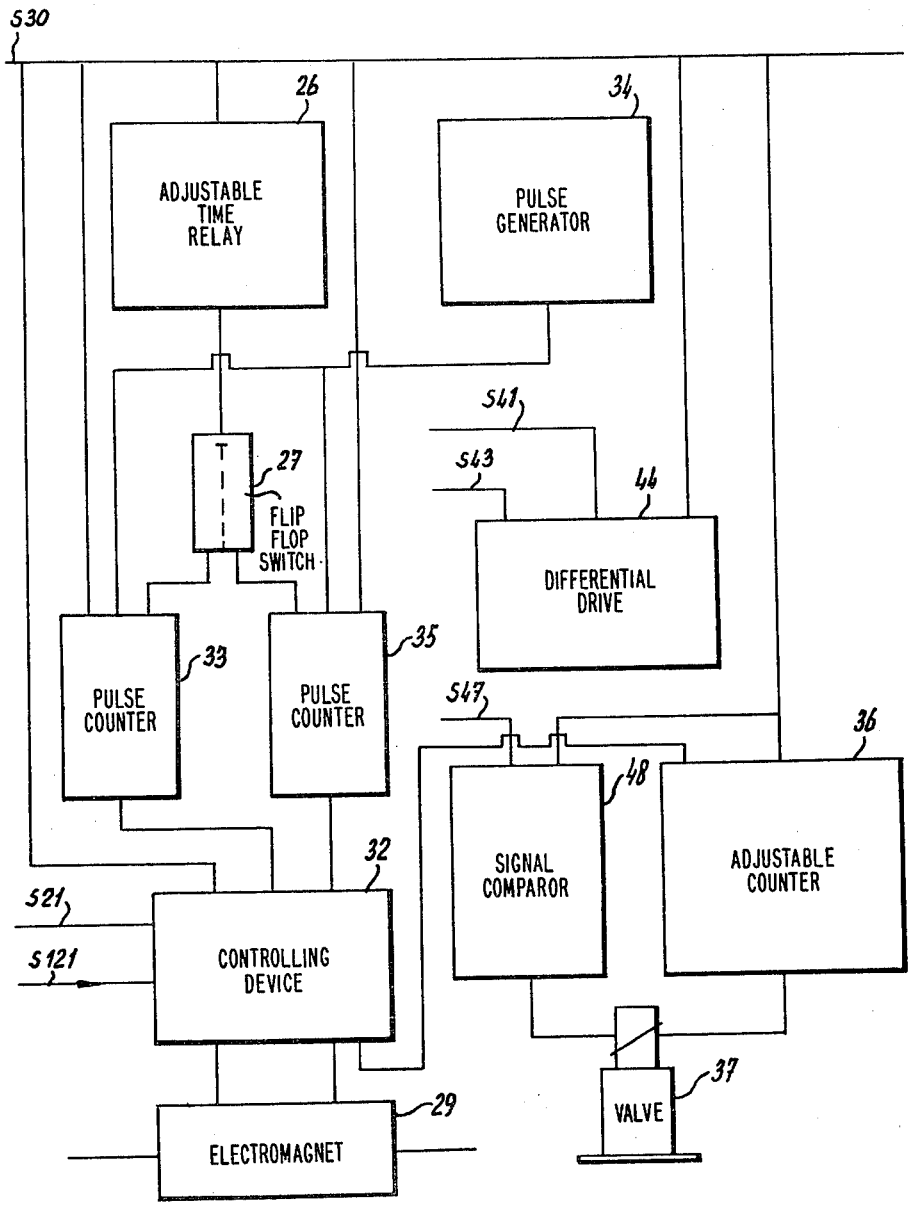
Figure 3A:
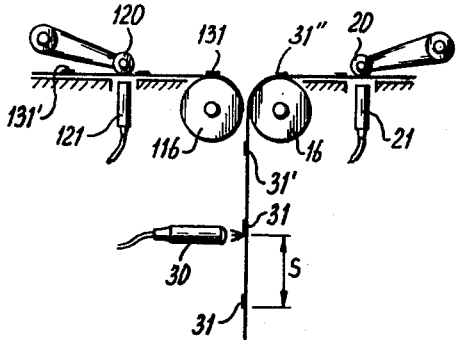
Figure 3B:
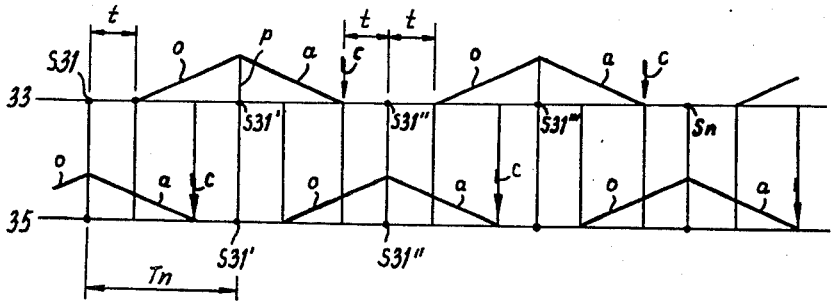
Figure 4:
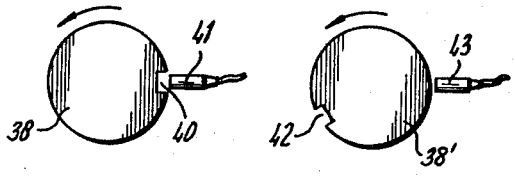
Figure 5:
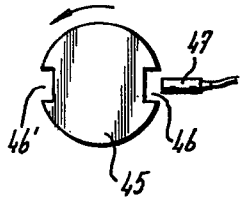
Figure 6:
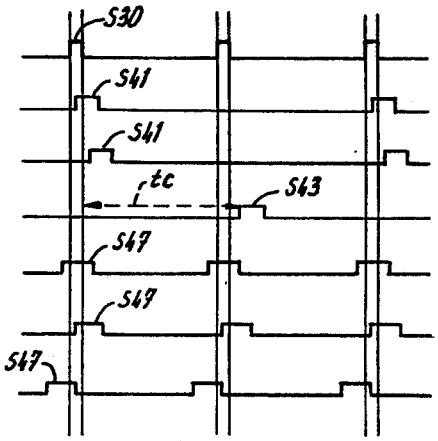

The invention will be explained in more detail with reference to the drawings, in which FIG. 1 schematically shows in side view a packing machine having an apparatus according to the invention for splicing the packing material webs, FIG. 2 shows a switching device according to the invention, FIG. 3*a* and 3*b* show the operation of the apparatus according to the invention, FIG. 4 shows the control means for controlling the velocity of the material web in a apparatus according to FIG. 1, FIG. 5 shows the control means according to the invention for removing articles being not packed correctly, and FIG. 6 shows the operation of the means according to FIGS. 4 and 5.

As shown in FIG. 1 the packing machine comprises a conveyor 1 having catchers 2 for supplying the articles 3 to be packed which are advanced into the folding box 4 by the conveyor 1. In said folding box 4 the material web 5 is folded to a tube 5' enveloping the articles 3, and advanced by the rotatable driving and sealing rollers 6 and is provided with a longitudinal sealing seam 5". Further there are provided the cooperating rotatable sealing jaws 7 and 7' which form a transverse sealing seam in the material web tube 5' always between two articles 3, which sealing seam is cut simultaneously so that behind the sealing jaws 7 and 7' the separately packed articles 8 are obtained and discharged by means of the discharge conveyor 9.

The material web 5 is unwound from the supply roll 10, said web extending via the roller 11, the roller 12 provided at the compensation lever 13 and the roller 14 over the table 15. From said table 15 the material web 5 passes over the roller 16 to the adjusting device 17 and subsequently through the roller 18 to the folding box 4. Further there are still provided a protector 19 to safeguard against reverse motion and a command roller 20, while underneath the table 15 opposite to a slot provided therein an inductive sensor 21 is provided displaceable within the area 22.

At the other side a packing material supply roll 110 is provided, of which the web 105 is guided in the same way as the web 5 via the rollers 111, 112, 114 over the table 115. However, here the leading end portion 105' of the web 105 is placed over the roller 116, which roller 116 is spaced from the roller 16. On top of the table 115 a protector 119 to safeguard against reverse motion and a command roller 120 are provided, whereas underneath the table 115 opposite to the slot provided therein an inductive sensor 121 is provided displaceable within the area 122.

The rollers 16 and 116 are fixed at the one end of the arms 23 and 23' respectively which arms are mounted for a pivotal motion at the points 24 and 24' respectively. At their other ends the arms 23 and 23' respectively are fixed to the toggle levers 25 and 25', which levers are connected to the electromagnet 29 so that in energizing the magnet 29 the rollers 16 and 116 are moved towards each other and finally pressed against each other by which the leading end portion 5' of the material web 105 can be spliced to the trailing end portion of the material web 5 by means of an adhesive provided on the end portion 105'.

At 30 an inductive sensor is provided capable of sensing the marks 31 provided on the material webs 5 and 105. Said marks 31 are equally spaced, which spacings correspond approximately to the length of an article 3 to be packed, so that by such an adjustment that the transverse sealing seams are formed by the sealing jaws 7 and 7' always substantially at the location of a mark 31, each packed article 8 fully shows the pattern printed between every two marks on the webs 5 or 105.

When in operation of the apparatus the packing material supply roll 10 is unwound totally, or when a rupture occurs in the packing material web on the roll 10, then by the inductive sensor 21 a loose end of the web 5 is detected, because thereby the command roller 20 moves downwardly and the sensor 21 is energized. As a consequence a signals 21 is delivered to a controlling device 32 (FIG. 2) being conditioned thereby so that said controller 32 can deliver a command to the electromagnet 29 before said loose end is advanced beyond the roller 16. In this way, the rollers 16 and 116 are pressed against each other and said loose end of the web 5 is spliced to the loose end 105' of the web 105 passed around the roller 116, after which the web 105 is entrained by the web 5 and the roll 110 is unwound without stopping of the packing machine.

While the roll 110 is unwound a new roll of packing material 10 is provided, the loose leading end of which is placed over the roller 16 in the same way as is shown in FIG. 1 for the end 105' over the roller 116, so that when the web 105 is unwound entirely from the roll 110 its trailing end is spliced to said loose leading end, the loose trailing end of the web 105 being sensed by the inductive sensor 121 by which a signal s121 is delivered to the controlling device 32.

The command to the electromagnet 29 is delivered by the controlling device 32 in response of the signal s30 from the photo cell 30 when a mark 31 or 131 passes said photo cell. However, the command may not be delivered until a moment at which for example a mark 31 on the web 5 approaching the roller 16 is at the same distance from the vertical center line of the roller 16 as the distance by which a mark 131 on the web 105 is positioned from the vertical center line of roller 116, in order to assure that the marks 131 on the web 105, when said web is spliced to the web 5, form an uninterrupted row with the marks 31 on the material web 5. However, this is only true when upon the command to the electromagnet 29 the rollers 16, 116 instantly engage each other, which is never the case as the electromagnet has a certain excitation time t dependent upon the design and the mass to be accelerated. Therefore the command to the electromagnet should be delivered on a moment t units of time before the above mentioned moment.

According to the invention this is achieved as shown in FIG. 2, in that the signal s30 actuates an adjustable time relay 26 which after the lapse of the time t, is reset to zero and causes the pulse counter 33 to operate through the flip flop switch 27. The pulse counter 33 counts the pulses from the pulse generator 34 driven synchronously with the driving means of the packing machine until the subsequent signal s30 is delivered after which the pulse counter 33 counts down to zero again. Upon arriving at zero of the pulse counter 33 by the controlling device 32 a command is given to the electromagnet 29 if the controlling device 32 is conditioned by a signal s21 or s121. By the second signal s30 the time relay 26 is actuated again by which after the time t the second pulse counter 35 begins to count the pulses from pulse generator 34 through the flip flop switch 27, at which moment the pulse counter 33 is counting down. So alternately the one pulse counter is counting up and the other is counting down by which it is achieved that always within a range between two marks 31 or 131 a command can be delivered to the electromagnet 29.

This is illustrated in the FIGS. 3*a* and 3*b*, of which FIG. 3*a* partly shows the apparatus according to FIG. 1 in which only the parts are shown which are important for the operation and in FIG. 3*b* the operation is shown graphically.

In FIG. 3*b* in the upper part the operation with the pulse counter 33 and in the lower part with the pulse counter 35 is shown. The signal s31 produced by the photo cell 30 when mark 31 has passed said cell causes the pulse counter 33 to count after time t through the time relay 26 as indicated by the line o. After a second signal 31' is generated by the photo cell 30 the pulse counter having counted p pulses counts down to zero as indicated by the line a. Upon arriving at zero of the pulse counter 33 the command c is delivered to the electromagnet 29. The number of counted pulses p corresponds with the time Tn−t, in which Tn is equal to the spacing s between the marks 31 divided by the velocity of the material web 31. At the same time the pulse counter 35 operates as indicated in the lower part of FIG. 3*b*. From FIG. 3*b* it appears that always at a moment t units of time before the moment at which a mark 31 passes the photo cell 30 a command can be delivered to the electromagnet 29 if the controlling device 32 is conditioned by a signal s21 or s121 so that the rollers 16 and 116 engage each other and the one material web is spliced to the other at the moment that a signal is developed by the photo cell 30 at which moment for example the mark 31" in FIG. 3*a* is at the correct distance from the mark 131 so that after splicing said marks will coincide.

As shown in FIG. 2, upon the command to the electromagnet 29 by the controlling device 32 at the same time an adjustable counter 36 is actuated which after having counted a set number of marks opens the valve 37, for example an electropneumatic valve, (see also FIG. 1) by which the source of pressurized air 38, is brought into open communication with a blowing nozzle 39 so that the packed articles 8 passing said blowing nozzle 39 are blown from the conveyor 9 and received in the receptacle 40. The counter is adjusted such that the packed articles blown from the conveyor 9 are those articles which are packed in the portion of the packing material web comprising the splice of the material webs.

As already mentioned above, in the apparatus according to FIG. 1 it is of great importance that the transverse sealing seams produced by the sealing jaws 7 and 7' are formed accurately with respect to the marks 31. This means that the velocity at which the packing material tube 5' advances, which velocity is defined by the driving and sealing rollers 6, should be constant and adapted to the constant rotational velocity of the sealing jaws 7 and 7'. However, a constant velocity of the material web tube 5' cannot be realized as slip of the rollers 6 and stretch in the material web 5 may occur, while also variations in the spacings between the marks 31 influences said velocity.

Therefore the velocity of the packing web 5 is checked continuously and adjusted if necessary. Therefore, as shown in FIG. 4, two command disks 38 and 38' are provided which are driven in rotation synchronously with the driving means of the packing machine. In the disk 38 a recess 40 is provided while an inductive sensor 41 opposes the disk so that always when the recess 40 passes the inductive sensor 41 a signal s41 is developed. In the command disk 38' a recess 42 is provided which is shifted by a predetermined length of arch with respect to the recess 40 is disk 38, while an inductive sensor 43 oppose the disk 38' and excites a signal s43 when recess 42 passes said sensor.

The signals s30 excited by the photo cell 30 in response to the passing of marks 31 are continuously compared with the signals s41 as indicated in the three upper lines of FIG. 6. If the signal s41 falls within the signal s30 as shown in the second line from the top in FIG. 6, then the velocity of the material web needs not to be varied. However, if the signal s41 falls outside the signal s30 as indicated in the third line from the top in FIG. 6, then, through a differential drive 44 (FIG. 2) the velocity of the material web 5 is varied until a signal s43 is delivered so that there occurs a certain correction time tc. If the velocity of the material web is still not obtained which is indicated by the subsequent signal s41 in comparison to a signal s30, then this velocity is changed again during the correction time tc and so on.

However, it may happen that the correction of the velocity of the material web during the correction time tc becomes too high or too low for a correct positioning of the transverse sealing seams in the packing material resulting in some packed articles not meeting the requirements. Therefore, said articles being packed incorrectly should be removed.

According to the invention any article packed incorrectly is removed automatically by using again the blowing nozzle 39. As shown in FIG. 5 the third command disk 45 is provided having two diametrically opposing recesses 46, 46', which recesses are of larger width than the recesses 40 and 42. Opposite to the disk 45 an inductive sensor 47 is provided exciting a signal s47 when a recess 46 or 46' passes the sensor. Each signal s47 is compared with a signal s30 in the device 48 (FIG. 2), in which the length of each signal s47 is equal to the length of the signal s30 increased at both sides by a distance corresponding to a predetermined tolerance length. If the signal s30 falls entirely within a signal s47 as shown in FIG. 6 at the third line from the bottom, then the transverse sealing seams are produced within the tolerance range correctly with respect to the marks. However, if a signal s30 falls outside a signal s47 as shown in the two lower lines in FIG. 6, then the device 48 opens the valve 37 so that the packed articles 8 being in front of the blowing nozzle 31, are blown from the conveyor 9 as said articles are packed beyond the tolerance length and have to be rejected. The blowing nozzle 39 continues to blow until the signal s30 falls within a signal s47 again.

I claim:

1. A method of splicing a trailing end portion of an advancing web of packing material to a leading end portion of an initially stationary second web of packing material such that after splicing, marks provided on each of the webs in an equally spaced relation continue as an uninterrupted regular row, in a packing machine, said method comprising the steps of: running the first web over a roller, placing the leading end portion provided with an adhesive of the second web over a second roller opposite to the first roller, exciting an initiating signal upon the trailing end of the first web passing a predetermined point, supplying the signal to a controlling device for conditioning the same, generating a second signal upon a mark on the first web passing a predetermined point, by which second signal the conditioned controlling device delivers a command to a displacing device for pressing said rollers against each other and for carrying out the splicing, determining the period of time (t) between the actuation of the displacing device and the pressing together of said rollers, and setting a lapse of time (Tn−t) between the signal generated by said mark and the command from the controlling device, Tn being the time obtained by dividing at least one spacing between two subsequent marks by the velocity of the first web.

2. A method according to claim 1, comprising actuating a time relay by said second signal to cause a pulse counter to operate after the time (t) and resetting the same to zero again, said pulse counter counting pulses delivered by a first pulse generator driven synchronously with a driving means of the packing machine until a third signal is generated by a mark, whereby the pulse counter counts down to zero again, and at arriving at zero causing the conditioned controlling device to deliver the command to the displacing device.

3. A method according to claim 2, wherein the third signal generated by a mark also actuates said time relay, which after the time (t) causes a second pulse counter to operate for counting pulses generated by the pulse generator until a fourth signal is generated by a mark, whereafter the second pulse counter counts down to zero again and upon arriving at zero causes the conditioned controlling device to deliver the command to the displacing device.

4. A method according to any one of claims 1 to 3, comprising: actuating a counter by the command to the displacing device at the same time, which counter after a set count of the signals generated by marks opens a valve of a blowing nozzle, said nozzle blowing at least one packed article from a discharge conveyor, said count being set so that said packed article is packed in the portion of the packing material containing the splice between the first and second web.

5. A method according to claim 4, passing each signal generated by a mark also to another controlling device, in said other controlling device comparing said last mentioned signal with a signal generated by a signal generator driven synchronously with a driving means of the packing machine, said comparing device, when the mark signal does not fall within the signal generated by the signal generator, opening the valve of the blowing nozzle until the latter signal falls within the first mentioned signal again.

6. An apparatus for splicing a trailing end portion of an advancing web of packing material to a leading end portion provided with an adhesive of a second initially stationary web of packing material such that after splicing marks provided on each of said webs in an equally spaced relation continue as an uninterrupted regular row, in a packing machine, said splicing apparatus comprising: two opposing rollers, means for pressing said rollers against each other, the advancing web being passed over one of said rollers and the end portion of the second web being placed over the other roller, first means located in front of said rollers as seen in the direction of movement of the advancing web, for generating a first signal when the end of the advancing web passes said first means, a controlling device conditioned by said generated signal, second means for generating a second signal when a mark on the material web passes said second means, and for causing the conditioned controlling device to deliver a command to said pressing means, and a pulse generator driven synchronously with driving means of said packing machine, a time relay actuated by the second signal from a mark, and a pulse counter put into operation by said time relay after the elapse of a predetermined time for counting the pulses generated by said pulse generator, for counting down to zero again by a third signal produced by a mark and for causing, upon arriving at zero, the controlling device to deliver the command for pressing the rollers against each other.

7. An apparatus according to claim 6, comprising a second pulse counter, and a flip-flop switch, both pulse counters being connected to said time relay by said flip-flop switch.

8. An apparatus according to claim 6, comprising a counter operatively connected to said controlling device to be actuated by said command, said packing machine having a discharge conveyor and a blowing nozzle having a self-closing valve, said counter being connected to said valve for opening the same.

9. An apparatus according to claim 8, comprising a signal generator driven synchronously with sealing jaws of the packing machine, and a controlling device with comparing means for comparing a signal generated by a mark with a signal from said signal generator, for opening said valve when the mark signal does not fall within the signal from the signal generator, until the mark signal falls within the signal from the signal generator.

10. An apparatus according to claim 9, wherein said signal generator comprises a rotatable disk, at least one generally rectangular portion cut out circumferentially in said disk, and an inductive sensor located opposite said disk so that when said at least one rectangular portion passes the sensor a signal is excited having a time period proportional to the length of the rectangular portion.

11. An apparatus according to any one of claims 6 to 10, comprising an electromagnet pressing the rollers against each other, each roller being provided at one end of an arm mounted rotatably near its center, and a toggle lever connecting the other ends of the arms to the electromagnet.

* * * * *